US008987177B2

(12) United States Patent
Okada et al.

(10) Patent No.: US 8,987,177 B2
(45) Date of Patent: Mar. 24, 2015

(54) BIODEGRADABLE LUBRICANT COMPOSITION

(75) Inventors: Tahei Okada, Ichihara (JP); Yukitoshi Fujinami, Ichihara (JP); Takuya Ohno, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 13/319,462

(22) PCT Filed: May 6, 2010

(86) PCT No.: PCT/JP2010/057750
§ 371 (c)(1),
(2), (4) Date: Nov. 8, 2011

(87) PCT Pub. No.: WO2010/128658
PCT Pub. Date: Nov. 11, 2010

(65) Prior Publication Data

US 2012/0053098 A1 Mar. 1, 2012

(30) Foreign Application Priority Data

May 8, 2009 (JP) ..... 2009-113508

(51) Int. Cl.

| | |
|---|---|
| ***C10M 169/04*** | (2006.01) |
| ***C10M 105/34*** | (2006.01) |
| ***C10M 105/36*** | (2006.01) |
| ***C10M 137/08*** | (2006.01) |

(52) U.S. Cl.
CPC ..... *C10M 169/04* (2013.01); *C10M 2203/1006* (2013.01); *C10M 2205/0285* (2013.01); *C10M 2207/2815* (2013.01); *C10M 2207/2825* (2013.01); *C10M 2207/289* (2013.01); *C10M 2207/2895* (2013.01); *C10M 2207/301* (2013.01); *C10M 2209/102* (2013.01); *C10M 2209/104* (2013.01); *C10M 2215/086* (2013.01); *C10M 2215/223* (2013.01); *C10M 2215/28* (2013.01); *C10M 2219/066* (2013.01); *C10M 2223/043* (2013.01); *C10M 2223/047* (2013.01); *C10M 2229/02* (2013.01); *C10N 2220/022* (2013.01); *C10N 2220/10* (2013.01); *C10N 2230/02* (2013.01); *C10N 2230/06* (2013.01); *C10N 2230/10* (2013.01); *C10N 2230/64* (2013.01); *C10N 2240/02* (2013.01); *C10N 2240/04* (2013.01)
USPC ..... 508/437; 508/463; 508/496

(58) Field of Classification Search
CPC ..... C10M 2207/301; C10M 2207/283
USPC ..... 508/437, 463, 496
See application file for complete search history.

(56) References Cited

U.S. PATENT DOCUMENTS

| | | | | |
|---|---|---|---|---|
| 5,411,672 | A | 5/1995 | Kagaya et al. | |
| 5,552,068 | A * | 9/1996 | Griffith | 508/436 |
| 6,462,001 | B1 | 10/2002 | Kenbeek et al. | |
| 2009/0176670 | A1 | 7/2009 | Kawasaki | |
| 2010/0009880 | A1 | 1/2010 | Okada | |

FOREIGN PATENT DOCUMENTS

| | | |
|---|---|---|
| JP | 53 102307 | 9/1978 |
| JP | 53 127970 | 11/1978 |
| JP | 05 098276 | 4/1993 |
| JP | 2001 003069 | 1/2001 |
| JP | 2003 522204 | 7/2003 |
| JP | 2005 520038 | 7/2005 |
| JP | 2005-213451 | 8/2005 |
| JP | 2008 088301 | 4/2008 |
| JP | 2008-115301 | 5/2008 |
| JP | 2008 274190 | 11/2008 |
| WO | WO 99/16849 A1 | 4/1999 |
| WO | 2008 038701 | 4/2008 |

OTHER PUBLICATIONS

Croda Lubricants, Product Summary for Priolube 3970.*
Extended European Search Report issued Oct. 17, 2012 in European Patent Application No. 10772176.3.
U.S. Appl. No. 13/320,696, filed Nov. 15, 2011, Okada, et al.
International Search Report Issued Jun. 1, 2010 in PCT/JP10/057750 Filed May 6, 2010.
Office Action issued Dec. 28, 2012 in Chinese Patent Application No. 201080020907.4 (with English translation).
European Office Action in corresponding application No. 10 772 176.3 dated Jun. 19, 2013.
T. Bartels, et al., "Lubricants and Lubrication", Ullmann's Encyclopedia of Industrial Chemistry, Jan. 15, 2003, p. 51-54, XP055065552.
U.S. Appl. No. 14/342,228, filed Feb. 28, 2014, Ohno, et al.
Office Action in corresponding European application No. 10772176.3-1352/2428552, dated Jun. 18, 2014.
"Priolube 3970", Jan. 1, 2011, XP055119804, Retrieved from the Internet: URL:http://www.innovadex.com/documents/1121100.pdf? bs=3379&b=191631 &st=20 retrieved on May 23, 2014.

* cited by examiner

*Primary Examiner* — Vishal Vasisth
(74) *Attorney, Agent, or Firm* — Oblon, McClelland, Maier & Neustadt, L.L.P.

(57) ABSTRACT

A biodegradable lubricating oil composition includes (A) an ester being obtained by reacting a saturated aliphatic carboxylic acid, a straight-chain aliphatic dicarboxylic acid and a polyhydric alcohol together, the ester having a kinematic viscosity in a range from 400 $mm^2/s$ to 1000 $mm^2/s$ at 40 degrees C. and an acid value of 0.5 mgKOH/g or less; (B) an ester being obtained by reacting a straight-chain saturated aliphatic carboxylic acid with a polyhydric alcohol, the ester having an acid value of 0.5 mgKOH/g or less; and (C) a phosphate amine salt being obtained by reacting an acidic phosphate with an alkylamine.

19 Claims, No Drawings

BIODEGRADABLE LUBRICANT COMPOSITION

This application is a 371 of PCT/JP2010/057750, filed May 6, 2010.

TECHNICAL FIELD

The present invention relates to a lubricating oil composition. More specifically, the present invention relates to a biodegradable lubricating oil composition usable for a step-up gear used, in particular, for wind power generation.

BACKGROUND ART

In recent years, due to exhaustion of fossil fuels and environmental issues, wind power generation, which uses natural energy, has been receiving considerable attention. Since wind power generation requires an increased power generation efficiency due to a low rotation speed of a rotor, a step-up gear is provided in a power generator. A so-called gear oil is used to lubricate a gear mechanism used in the step-up gear, and is required to provide a considerably high lubricity.

Typically, a lubricating oil whose base oil is PAO (polyalphaolefin) has been used as a step-up gear oil. Since a wind power generator is frequently used on the ocean or under the natural environment, the step-up gear oil should be highly biodegradable. The typical PAO lubricating oil, however, has little biodegradability, so that an alternative thereto has been sought for.

As a lubricating oil intended to be used for a step-up gear in a wind power generator, a lubricating oil whose base oil is ester can be applicable because such a lubricating oil needs to be biodegradable (see, for instance, Patent Literatures 1 and 2). Each of Patent Literatures 1 and 2 has suggested a biodegradable lubricating oil whose base oil is a complex ester obtained from a polyhydric alcohol and a polycarboxylic acid.

CITED LIST

Patent Literatures

| | |
|---|---|
| Patent Literature 1 | JP-T-2003-522204 |
| Patent Literature 2 | JP-T-2005-520038 |

SUMMARY OF THE INVENTION

Problems to be Solved by the Invention

The biodegradable lubricating oils disclosed in Patent Literature 1 and 2 do not have a sufficient oxidation stability, so that when being used for a step-up gear in a wind power generator, the biodegradable lubricating oils are unlikely to continuously exhibit properties as a lubricating oil for a long time.

Accordingly, an object of the invention is to provide a biodegradable lubricating oil composition that is excellent in lubricity, oxidation stability and biodegradability and is suitable for a step-up gear used in a wind power generator.

Means for Solving the Problems

In order to solve the above problem, the following biodegradable lubricating oil composition is provided according to an aspect of the invention.

(1) A biodegradable lubricating oil composition including (A) an ester being obtained by reacting a saturated aliphatic carboxylic acid, a straight-chain aliphatic dicarboxylic acid and a polyhydric alcohol together, the ester having a kinematic viscosity in a range from 400 $mm^2/s$ to 1000 $mm^2/s$ at 40 degrees C. and an acid value of 0.5 mgKOH/g or less; (B) an ester being obtained by reacting a straight-chain saturated aliphatic carboxylic acid with a polyhydric alcohol, the ester having an acid value of 0.5 mgKOH/g or less; and (C) a phosphate amine salt being obtained by reacting an acidic phosphate with an alkylamine.

(2) In the above biodegradable lubricating oil composition, the saturated aliphatic carboxylic acid in the component (A) has 6 to 24 carbon atoms.

(3) In the above biodegradable lubricating oil composition, the straight-chain aliphatic dicarboxylic acid in the component (A) has 12 carbon atoms or less.

(4) In the above biodegradable lubricating oil composition, the straight-chain saturated aliphatic carboxylic acid in the component (B) has 6 to 12 carbon atoms.

(5) In the above biodegradable lubricating oil composition, the polyhydric alcohol used to provide at least one of the esters of the components (A) and (B) is at least one of pentaerythritol and trimethylolpropane.

(6) In the above biodegradable lubricating oil composition, a kinematic viscosity of the component (B) is in a range from 20 $mm^2/s$ to 40 $mm^2/s$ at 40 degrees C.

(7) In the above biodegradable lubricating oil composition, a blend ratio of the component (B) is 10 mass % or more of a total amount of the lubricating oil composition.

(8) In the above biodegradable lubricating oil composition, the acidic phosphate in the component (C) has 8 to 13 carbon atoms.

(9) In the above biodegradable lubricating oil composition, a blend ratio of the phosphate amine salt in the component (C) is in a range from 0.2 mass % to 1 mass %.

(10) In the above biodegradable lubricating oil composition, the biodegradable lubricating oil composition is a gear oil.

The biodegradable lubricating oil composition according to the aspect of the invention is excellent in lubricity, oxidation stability and biodegradability, and thus is suitable for a step-up gear used in a wind power generator.

DESCRIPTION OF EXEMPLARY EMBODIMENT

A biodegradable lubricating oil composition according to an exemplary embodiment of the invention (hereinafter also referred to simply as "the composition") is provided by blending (A) an ester being obtained by reacting a saturated aliphatic carboxylic acid, a straight-chain aliphatic dicarboxylic acid and a polyhydric alcohol together, (B) an ester being obtained by reacting a straight-chain saturated aliphatic carboxylic acid with a polyhydric alcohol, and (C) a phosphate amine salt being obtained by reacting an acidic phosphate with an alkylamine. A detailed description of this exemplary embodiment will be made below.

Component (A)

The component (A) of the exemplary embodiment is a so-called complex ester obtained by reacting a saturated aliphatic carboxylic acid, a straight-chain aliphatic dicarboxylic acid and a polyhydric alcohol together.

The saturated aliphatic carboxylic acid may be a branched fatty acid or a straight-chain fatty acid. However, considering oxidation stability, the saturated aliphatic carboxylic acid is more preferably a saturated monocarboxylic acid having 6 carbon atoms or more. In order to ensure fluidity at a low temperature, the saturated monocarboxylic acid preferably has 24 carbon atoms or less.

Examples of such an aliphatic saturated monocarboxylic acid include straight-chain saturated monocarboxylic acids such as caproic acid, enanthic acid, caprylic acid, pelargonic acid, capric acid, undecanoic acid, lauric acid, tridecanoic acid, myristic acid, pentadecanoic acid, palmitic acid, heptadecanoic acid, stearic acid, nonadecanoic acid, arachic acid and behenic acid; and branched saturated monocarboxylic acids such as isomyristic acid, isopalmitic acid, isostearic acid, 2,2-dimethylbutanoic acid, 2,2-dimethylpentanoic acid, 2,2-dimethyloctanoic acid, 2-ethyl-2,3,3-trimethylbutanoic acid, 2,2,3,4-tetramethylpentanoic acid, 2,5,5-trimethyl-2-t-butylhexanoic acid, 2,3,3-trimethyl-2-ethylbutanoic acid, 2,3-dimethyl-2-isopropylbutanoic acid, 2-ethylhexanoic acid and 3,5,5-trimethylhexanoic acid. For esterification, one of the above examples of the aliphatic monocarboxylic acid may be used alone or, alternatively, two or more thereof may be used in combination.

Examples of the straight-chain aliphatic dicarboxylic acid include adipic acid, pimelic acid, suberic acid, azelaic acid, sebacic acid, undecanedioic acid, dodecanedioic acid, tridecanedioic acid, tetradecanedioic acid, pentadecanedioic acid, octadecanedioic acid, nonadecanedioic acid and eicosanedioic acid. For esterification, one of the above examples of the straight-chain aliphatic dicarboxylic acid may be used alone or, alternatively, two or more thereof may be used in combination.

Among the above examples of the straight-chain aliphatic dicarboxylic acid, one having 12 carbon atoms or less is preferably used to maintain fluidity at a low temperature.

As the polyhydric alcohol used to provide the component (A), a so-called hindered polyol is suitably used. Examples of the hindered polyol include neopentyl glycol, 2-ethyl-2-methyl-1,3-propanediol, 2,2-diethyl-1,3-propanediol, trimethylol ethane, trimethylol propane, trimethylol butane, trimethylol pentane, trimethylol hexane, trimethylol heptane, pentaerythritol, 2,2,6,6-tetramethyl-4-oxa-1,7-heptanediol, 2,2,6,6,10,10-hexamethyl-4,8-dioxa-1,11-undecanediol, 2,2,6,6,10,10,14,14-octamethyl-4,8,12-trioxa-1,15-pentadecanediol, 2,6-dihydroxymethyl-2,6-dimethyl-4-oxa-1,7-heptanediol, 2,6,10-trihydroxymethyl-2,6,10-trimethyl-4,8-dioxa-1,11-undecanediol, 2,6,10,14-tetrahydroxymethyl-2,6,10,14-tetramethyl-4,8,12-trioxa-1,15-pentadecanediol, di(pentaerythritol), tri(pentaerythritol), tetra(pentaerythritol), and penta(pentaerythritol).

For esterification, one of the above examples of the hindered polyol may be used alone or, alternatively, two or more thereof may be used in combination.

The complex ester as the component (A) is obtained by reacting the above saturated aliphatic carboxylic acid, straight-chain aliphatic dicarboxylic acid and polyhydric alcohol together, and has a kinematic viscosity in a range from 400 $mm^2/s$ to 1000 $mm^2/s$ at 40 degrees C. When the kinematic viscosity is less than 400 $mm^2/s$, the resulting lubricating oil composition is unlikely to have a viscosity required for maintaining lubricity. When the kinematic viscosity is more than 1000 $mm^2/s$, the biodegradability of the resulting lubricating oil composition is likely to be lowered.

The component (A) is required to have an acid value of 0.5 mgKOH/g or less. When the acid value is more than 0.5 mgKOH/g, the oxidation stability of the resulting lubricating oil composition is likely to be deteriorated.

Incidentally, in order to obtain an ester as the component (A), two kinds of carboxylic acids and a polyhydric alcohol are typically reacted together as described above. However, the ester may be obtained in a different way as long as the resulting ester structure includes the above carboxylic acid residue and polyhydric alcohol residue. It is not necessary that starting materials (reactants) are the above carboxylic acids and polyhydric alcohol, and, furthermore, the component (A) does not necessarily have to be composited based on dehydration reaction thereof. The component (A) may be composited from other materials in a different way. For instance, the component (A) may be produced by transesterification.

Component (B)

The component (B) of the exemplary embodiment is an ester obtained by reacting a straight-chain saturated aliphatic carboxylic acid with a polyhydric alcohol.

For maintaining biodegradability and low temperature fluidity, a carboxylic acid having 6 to 12 carbon atoms is preferably used as the straight-chain saturated aliphatic carboxylic acid. Examples of such a carboxylic acid include monocarboxylic acids such as caproic acid, enanthic acid, caprylic acid, pelargonic acid, capric acid, undecane acid and lauric acid. Incidentally, since using one kind of carboxylic acid alone may result in solidification, several kinds of carboxylic acids are preferably used in combination.

As the polyhydric alcohol, a hindered polyalcohol is preferably used in the same manner as the polyhydric alcohol used to provide the component (A).

The component (B) preferably has a kinematic viscosity in a range from 20 $mm^2/s$ to 40 $mm^2/s$ at 40 degrees C. When the kinematic viscosity is less than 20 $mm^2/s$, the lubricity of the resulting lubricating oil composition is unfavorably lowered. When the kinematic viscosity is more than 40 $mm^2/s$, the low-temperature fluidity of the resulting lubricating oil composition is likely to be deteriorated.

The component (B) is required to have an acid value of 0.5 mgKOH/g or less. When the acid value is more than 0.5 mgKOH/g, the oxidation stability of the resulting lubricating oil composition is likely to be deteriorated.

Incidentally, an ester as the component (B) is typically obtained by reacting the above predetermined carboxylic acid and polyhydric alcohol together. However, the ester may be obtained in a different way as long as the resulting ester structure includes the above carboxylic acid residue and polyhydric alcohol residue. It is not necessary that starting materials (reactants) are the above carboxylic acid and polyhydric alcohol, and, furthermore, the component (B) does not necessarily have to be composited based on dehydration reaction thereof. The component (B) may be composited from other materials in a different way. For instance, the component (B) may be produced by transesterification.

The blend ratio of the component (B) of the exemplary embodiment is preferably 10 mass % or more of the total amount of the composition in terms of biodegradability.

Component (C)

The component (C) of the exemplary embodiment is a phosphate amine salt obtained by reacting an acidic phosphate with an alkylamine.

The acidic phosphate used to provide the component (C) is exemplified by one having the structure represented by, for instance, the following formula (1).

Formula 1

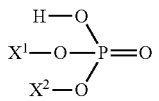

(1)

In the formula, $X^1$ is a hydrogen atom or an alkyl group having 6 to 20 carbon atoms, and $X^2$ is an alkyl group having 6 to 20 carbon atoms. The above alkyl group having 6 to 20 carbon atoms may have a straight-chain, branched, or cyclic structure. Examples of the alkyl group include various hexyl groups, octyl groups, decyl groups, dodecyl groups, tetradecyl groups, hexadecyl groups, octadecyl groups and icosyl groups. Among the above, an alkyl group having 8 to 18 carbon atoms is preferable and an alkyl group having 8 to 13 carbon atoms is more preferable.

Examples of acidic alkyl phosphates represented by the formula (1) include acidic monophosphates such as monooctyl acid phosphate, monodecyl acid phosphate, monoisodecyl acid phosphate, monolauryl acid phosphate, mono(tridecyl) acid phosphate, monomyristyl acid phosphate, monopalmityl acid phosphate and monostearyl acid phosphate; and acidic diphosphates such as dioctyl acid phosphate, didecyl acid phosphate, diisodecyl acid phosphate, dilauryl acid phosphate, di(tridecyl) acid phosphate, dipalmityl acid phosphate and distearyl acid phosphate.

The component (C) may be provided using one of the above examples of the acidic phosphate alone or a combination of two or more thereof. Incidentally, the content of phosphorus (P) is preferably in a range from 150 mass ppm to 500 mass ppm of the total amount of the resulting composition. If the content of P is less than 150 mass ppm, the composition is unlikely to exhibit a sufficient seizure resistance when used as a gear oil. On the other hand, if the content of P is more than 500 mass ppm, the fatigue resistance (FZG micropitting resistance) of the composition is likely to be lowered. The content of P is preferably in a range from 250 mass ppm to 450 mass ppm, more preferably in a range from 350 mass ppm to 400 mass ppm.

The alkylamine used to provide the component (C) may be any one of primary amine, secondary amine and tertiary amine, but is preferably dialkylamine or trialkylamine in terms of improvement of seizure resistance. The phosphate amine salt in a liquid phase at room temperature (25 degrees C.) is preferable in terms of solubility to a base oil and prevention of precipitation at a low temperature. In view of this, an alkyl group having 6 to 20 carbon atoms is preferable.

Examples of dialkylamines include dihexylamine, dicyclohexylamine, dioctylamine, dilaurylamine and distearylamine. Examples of trialkylamines include trihexylamine, tricyclohexylamine, trioctylamine, trilaurylamine and tristearylamine.

One of the above examples of the alkylamine may be used alone or, alternatively, two or more thereof may be used in combination. In terms of seizure resistance, the alkylamine is favorably selected from the trialkyamines.

The blend ratio of the component (C) is preferably in a range from 0.2 mass % to 1 mass % of the total amount of the composition. The blend ratio less than 0.2 mass % results in a less effectiveness in reducing friction. When the blend ratio is more than 1 mass %, the fatigue resistance (FZG micropitting resistance) is likely to be lowered. The component (C) may be blended with the other components to prepare the composition after being provided as the acidic phosphate amine salt. Alternatively, the acidic phosphate and the alkylamine may be independently blended to prepare the composition.

Incidentally, in the instance where the acidic phosphate and the alkylamine are independently blended, the blend ratio of the component (C) corresponds to the total amount of the acidic phosphate and the alkylamine.

The composition may further be added with a predetermined sulfur compound as a component (D) to enhance the lubricity thereof. For instance, it is preferable to use a sulfur compound that does not contain a sulfur condensation of three (—S—S—S—) or more in a molecule (D-1) and in which sulfur atoms (S) are contained in the molecule at 15 mass % or more. Further, the component (D-1) is additionally blended with a sulfur compound (D-2), which is preferably a trihydrocarbyl thiophosphate represented by the following formula (2).

$$(RO—)_3P=S \quad (2)$$

In the formula (2), R is a hydrocarbyl group having 6 to 20 carbon atoms. When the sulfur compound as the component (D-1) is a compound having a sulfur condensation of three (—S—S—S—) or more or more contained in the molecule, a lot of sludge is likely to be generated in an oxidation stability test (described below) and, furthermore, the FZG micropitting resistance is likely to be lowered. When the content of S in the molecule is less than 15 mass %, the addition effect of the sulfur compound is not sufficiently exhibited, resulting in a shortage of the seizure resistance.

Examples of the sulfur compound based on the component (D-1) having the above properties include, for instance, the following compounds.

(1) mono- or di-olefin sulfide
(2) dihydrocarbyl mono- or di-sulfide
(3) thiadiazole compound
(4) dithiocarbamate compound
(5) ester compound having a disulfide structure
(6) other sulfur compounds Mono- or Di-olefin Sulfide The olefin sulfide can be exemplified by a compound represented by the following formula (3).

$$R^1\text{-Sa-}R^2 \quad (3)$$

In the formula (3), $R^1$ is an alkenyl group having 2 to 15 carbon atoms, $R^2$ is an alkyl or alkenyl group having 2 to 15 carbon atoms, and a is an integer of 1 or 2. Such a compound is obtained by reacting an olefin having 2 to 15 carbon atoms or any one of the dimer to tetramer thereof with a sulfurizing agent such as sulfur, sulfur chloride or the like. Preferred examples of the olefin include propylene, isobutene and diisobutene.

Dihydrocarbyl Mono- or Di-sulfide

The dihydrocarbyl mono- or di-sulfide can be exemplified by a compound represented by the following formula (4).

$$R^3—Sb—R^4 \quad (4)$$

In the formula (4), each of $R^3$ and $R^4$ is an alkyl or cyclic alkyl group having 1 to 20 carbon atoms, an aryl group having 6 to 20 carbon atoms, an alkylaryl group having 7 to 20 carbon atoms or an arylalkyl group having 7 to 20 carbon atoms, $R^3$ and $R^4$ may be mutually the same or different, and b is an integer of 1 or 2. When $R^3$ and $R^4$ are both alkyl groups, the compound is referred to as alkyl sulfide.

Preferred examples of the dihydrocarbyl mono- or di-sulfide include dibenzil mono- or di-sulfides, various dinonyl mono- or di-sulfides, various didodecyl mono- or di-sulfides, various dibutyl mono- or di-sulfides, various dioctyl mono- or di-sulfides, diphenyl mono- or di-sulfides, and dicyclohexyl mono- or di-sulfides.

Thiadiazole Compound

Preferred examples of the thiadiazole compound include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyldithio)-1,2,3-thiadiazole, and 4,5-bis(1,1,3,3-tetramethylbutyldithio)-1,2,3-thiadiazole Dithiocarbamate Compound Examples of the dithiocarbamate compound include alkylene bisdialkyl dithiocarbamates, among which preferred is a compound containing an alkylene group having 1 to 3 carbon atoms, a straight-chain or branched saturated or unsaturated alkyl group having 3 to 20 carbon atoms, or a cyclic alkyl group having 6 to 20 carbon atoms. Examples of the above dithiocarbamate compound include methylene bisdibutyldithiocarbamate, methylene bisdioctyldithiocarbamate and methylene bistridecyldithiocarbamate.

Ester Compound Having Disulfide Structure

Examples of the ester compound having a disulfide structure include a disulfide compound represented by the following formula (5) and a compound represented by the following formula (6).

$$R^5OOC\text{-}A^1\text{-}S\text{—}S\text{-}A^2\text{-}COOR^6 \quad (5)$$

$$R^{11}OOC\text{—}CR^{13}R^{14}\text{—}CR^{15}(COOR^{12})\text{—}S\text{—}S\text{—}C^{20}(COOR^{17})\text{—}CR^{18}R^{19}\text{—}COOR^{16} \quad (6)$$

In the formula (5), $R^5$ and $R^6$ each independently represent a hydrocarbyl group having 1 to 30 carbon atoms, preferably 1 to 20 carbon atoms, more preferably 2 to 18 carbon atoms, particularly preferably 3 to 18 carbon atoms. Such a hydrocarbyl group may have a straight-chain, branched or cyclic structure and may contain an oxygen atom, sulfur atom or nitrogen atom. $R^5$ and $R^6$ may be mutually the same or different, but are preferably the same in terms of manufacturing reasons.

$A^1$ and $A^2$ each independently represent $CR^7R^8$ or $CR^7R^8$—$CR^9R^{10}$, in which $R^7$ to $R^{10}$ each independently a hydrogen atom or a hydrocarbyl group having 1 to 20 carbon atoms. Such a hydrocarbyl group is preferably one having 1 to 12 carbon atoms, more preferably one having 1 to 8 carbon atoms. $A^1$ and $A^2$ may be mutually the same or different, but are preferably the same in terms of manufacturing reasons.

In the formula (6), $R^{11}$, $R^{12}$, $R^{16}$ and $R^{17}$ each independently represent a hydrocarbyl group having 1 to 30 carbon atoms, preferably 1 to 20 carbon atoms, more preferably 2 to 18 carbon atoms, particularly preferably 3 to 18 carbon atoms. Such a hydrocarbyl group may have a straight-chain, branched or cyclic structure and may contain an oxygen atom, sulfur atom or nitrogen atom. $R^{11}$, $R^{12}$, $R^{16}$ and $R^{17}$ may be mutually the same or different, but are preferably the same in terms of manufacturing reasons.

$R^{13}$ to $R^{15}$ and $R^{18}$ to $R^{20}$ each independently represent a hydrogen atom or a hydrocarbyl group having 1 to 5 carbon atoms. A hydrogen atom is preferred because materials are easily available.

Examples of the disulfide compound represented by the formula (5) include bis(methoxycarbonyl-methyl)disulfide, bis(ethoxycarbonylmethyl)disulfide, bis(n-propoxycarbonylmethyl)disulfide, bis(isopropoxycarbonylmethyl)disulfide, bis(cyclopropoxycarbonylmethyl)disulfide, 1,1-bis(1-methoxycarbonylethyl)disulfide, 1,1-bis(1-methoxycarbonyl-n-propyl)disulfide, 1,1-bis(1-methoxycarbonyl-n-butyl)disulfide, 1,1-bis(1-methoxycarbonyl-n-hexyl)disulfide, 1,1-bis(1-methoxycarbonyl-n-octyl)disulfide, 2,2-bis(2-methoxycarbonyl-n-propyl)disulfide, alpha,alpha-bis(alpha-methoxycarbonylbenzyl)disulfide, 1,1-bis(2-methoxycarbonylethyl)disulfide, 1,1-bis(2-ethoxycarbonylethyl)disulfide, 1,1-bis(2-n-propoxycarbonylethyl)disulfide, 1,1-bis(2-isopropoxycarbonylethyl)disulfide, 1,1-bis(2-cyclopropoxycarbonylethyl)disulfide, 1,1-bis(2-methoxycarbonyl-n-propyl)disulfide, 1,1-bis(2-methoxycarbonyl-n-butyl)disulfide, 1,1-bis(2-methoxycarbonyl-n-hexyl)disulfide, 1,1-bis(2-methoxycarbonyl-n-propyl)disulfide, 2,2-bis(3-methoxycarbonyl-n-pentyl)disulfide, and 1,1-bis(2-methoxycarbonyl-1-phenylethyl)disulfide.

Examples of the disulfide compound represented by the formula (6) include dimercaptosuccinic acid tetramethyl, dimercaptosuccinic acid tetraethyl, dimercaptosuccinic acid tetra-1-propyl, dimercaptosuccinic acid tetra-2-propyl, dimercaptosuccinic acid tetra-1-butyl, dimercaptosuccinic acid tetra-2-buhyl, dimercaptosuccinic acid tetraisobutyl, dimercaptosuccinic acid tetra-1-hexyl, dimercaptosuccinic acid tetra-1-octyl, dimercaptosuccinic acid tetra-1-(2-ethyl)hexyl, dimercaptosuccinic acid tetra-1-(3,5,5-trymethyl)hexyl, dimercaptosuccinic acid tetra-1-decyl, dimercaptosuccinic acid tetra-1-dodecyl, dimercaptosuccinic acid tetra-1-hexadecyl, dimercaptosuccinic acid tetra-1-octadecyl, dimercaptosuccinic acid tetrabenzyl, dimercaptosuccinic acid tetra-alpha-(methyl)benzyl, dimercaptosuccinic acid tetra alpha,alpha-dimethylbenzyl, dimercaptosuccinic acid tetra-1-(2-methoxy)ethyl, dimercaptosuccinic acid tetra-1-(2-ethoxy)ethyl, dimercaptosuccinic acid tetra-1-(2-butoxy)ethyl, dimercaptosuccinic acid tetra-1-(2-ethoxy)ethyl, dimercaptosuccinic acid tetra-1-(2-butoxy-butoxy)ethyl, and dimercaptosuccinic acid tetra-1-(2-phenoxy)ethyl Other Sulfur Compounds Examples of other sulfur compounds include sulfurized fats and oils such as sulfurized lard, sulfurized rape seed oil, sulfurized castor oil, sulfurized soybean oil and sulfurized rice bran oil; sulfurized fatty acids such as thioglycolic acid and sulfurized oleic acid; dialkyl thiodipropionate compounds such as dilauryl thiodipropionate, distearyl thiodipropionate and dimyristyl thiodipropionate; and thioterpene compounds obtained by reacting phosphorus pentasulfide with pinene.

The above component (D-1) may be provided using one of the above sulfur compounds alone or using a combination of two or more thereof. The blend ratio of the component (D-1) is preferably in a range from 0.2 mass % to 0.6 mass % of the total amount of the composition in terms of the amount of sulfur. The blend ratio less than 0.2 mass % can result in an insufficient seizure resistance. On the other hand, the blend ratio more than 0.6 mass % can result in not only a deteriorated fatigue resistance such as FZG micropitting resistance but also generation of a lot of sludge in an oxidation stability test (compliant with ASTM D 2893). The blend ratio is preferably in a range from 0.3 mass % to 0.5 mass %.

In blending the above component (D-1), preferably, the trihydrocarbyl thiophosphate represented by the formula (2) is also blended as the component (D-2) as desired.

In the formula (2), R is a hydrocarbyl group having 6 to 20 carbon atoms. Such a hydrocarbyl group is a straight-chain, branched or cyclic alkyl group or alkenyl group having 6 to 20 carbon atoms, an aryl group having 6 to 20 carbon atoms, or an aralkyl group having 7 to 20 carbon atoms. In the aryl group and aralkyl group, one or more alkyl group(s) may be introduced into an aromatic ring. The three RO groups may be mutually the same or different.

Examples of the alkyl group and alkenyl group each having 6 to 20 carbon atoms include various hexyl groups, various octyl groups, various decyl groups, various dodecyl groups, various tetradecyl groups, various hexadecyl groups, various octadecyl groups, cyclohexyl group, various hexenyl groups, various octenyl groups, various decenyl groups, various dodecenyl groups, various tetradecenyl groups, various hexadecenyl groups, various octadecenyl groups and cyclohexenyl group.

Examples of the aryl group having 6 to 20 carbon atoms include phenyl group, tolyl group, xylyl group, decylphenyl group, 2,4-didecylphenyl group and naphthyl group. Examples of the aralkyl group having 7 to 20 carbon atoms include benzyl group, phenethyl group, naphthylmethyl group, methylbenzyl group, methylphenethyl group and methylnaphthylmethyl group.

Examples of the trihydrocarbyl thiophosphate represented by the above formula (2) include trihexyl thiophosphate, tri2-ethylhexyl thiophosphate, tris(decyl)thiophosphate, trilauryl thiophosphate, trimyristyl thiophosphate, tripalmityl thiophosphate, tristearyl thiophosphate, trioleyl thiophosphate, tricresyl thiophosphate, trixylyl thiophosphate, tris(decylphenyl)thiophosphate and tris[2,4-isoalkyl(C9,C10)phenyl]thiophosphate. One of the above examples of the trihydrocarbyl thiophosphate may be used alone or, alternatively, two or more thereof may be used in combination.

The trihydrocarbyl thiophosphate as the component (D-2) is intended to be blended as desired in order to enhance the effectiveness of adding the sulfur compound as the above component (D-1). The blend ratio of the trihydrocarbyl thiophosphate is preferably in a range from 0.1 mass % to 1 mass % of the total amount of the composition in terms of the amount of sulfur, more preferably in a range from 0.2 mass % to 0.5 mass %.

As long as an object of the invention is not impaired, the composition may be added with at least one selected from various additives such as ashless detergent dispersant, antioxidant, rust inhibitor, metal deactivator, viscosity index improver, pour point depressant and antifoaming agent if necessary.

Examples of the ashless detergent dispersant include succinimides, boron-containing succinimides, benzylamines, boron-containing benzylamines, succinic acid esters, and carboxylic acid amides of mono- or di-carboxylic acid, a typical example of which is a fatty acid or succinic acid. The blend ratio of the ashless detergent dispersant is set approximately in a range from 0.01 mass % to 5 mass % of the total amount of the composition in view of a balance between the resulting effect and economic efficiency and the like.

As the antioxidant, ones typically used in a lubricating oil, i.e., an aminic antioxidant, phenolic antioxidant and sulfuric antioxidant, are usable. One of the above antioxidants may be used alone or, alternatively, two or more thereof may be used in combination. Examples of the aminic antioxidant include monoalkyldiphenylamine compounds such as monooctyldiphenylamine and monononyldiphenylamine; dialkyldiphenylamine compounds such as 4,4'-dibutyldiphenylamine, 4,4'-dibenzyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine compounds such as tetrabutyldiphenylamine, tetrahexyldiphenylamine, tetraoctyldiphenylamine and tetranonyldiphenylamine; and naphthylamine compounds such as alpha-naphthylamine, phenyl-alpha-naphthylamine, butylphenyl-alpha-naphthylamine, benzylphenyl-alpha-naphthylamine, hexylphenyl-alpha-naphthylamine, heptylphenyl-alpha-naphthylamine, octylphenyl-alpha-naphthylamine and nonylphenyl-alpha-naphthylamine.

Examples of the phenolic antioxidant include monophenol compounds such as 2,6-di-tert-butyl-4-methylphenyl, 2,6-di-tert-butyl-4-ethylphenyl and octadecyl 3-(3,5-di-tert-butyl-4-hydroxyphenyl)propionate; and diphenol compounds such as 4,4'-methylenebis(2,6-di-tert-butylphenol) and 2,2'-methylenebis(4-ethyl-6-tert-butylphenol).

Examples of sulfuric antioxidant include 2,6-di-tert-butyl-4-(4,6-bis(octylthio)-1,3,5-triazine-2-ylamino)phenol, thioterpene compound such as a reactant of phosphorus pentasulfide and pinene, and dialkyl thiodipropionate such as dilauryl thiodipropionate and distearyl thiodipropionate.

The blend ratio of the antioxidant is set approximately in a range from 0.3 mass % to 2 mass % of the total amount of the composition in view of a balance between the resulting effect and economic efficiency and the like.

Examples of the rust inhibitor include metal sulfonate and alkenyl succinic acid ester. The blend ratio of the rust inhibitor is set approximately in a range from 0.01 mass % to 0.5 mass % in view of the blend effect thereof.

Examples of the metal deactivator (copper corrosion inhibitor) include benzotriazole compounds, tolyltriazole compounds, thiadiazole compounds, imidazole compounds and pyrimidine compounds. Among the above, benzotriazole compounds are preferable. The blend ratio of the metal deactivator is set approximately in a range from 0.01 mass % to 0.1 mass % in view of the blend effect thereof.

Examples of the viscosity index improver include polymethacrylate, dispersed polymethacrylate, olefin copolymer (e.g. ethylene-propylene copolymer), dispersed olefin copolymer and styrene copolymer (e.g. styrene-diene copolymer and styrene-isoprene copolymer). The blend ratio of the viscosity index improver is set approximately in a range from 0.5 mass % to 15 mass % in view of the blend effect thereof.

Examples of the pour point depressant include ethylene-vinyl acetate copolymer, condensate of chlorinated paraffin and naphthalene, condensate of chlorinated paraffin and phenol, polymethacrylate and polyalkylstyrene, among which polymethacrylate of, for instance, approximately 50000 to 150000 (mass average molecular weight) is preferably used. The blend ratio of the pour point depressant is set approximately in a range from 0.1 mass % to 5 mass % of the total amount of the composition.

Preferred examples of the antifoaming agent include silicone polymer antifoaming agent and polyacrylate antifoaming agent. By blending silicone polymer antifoaming agent, antifoaming capabilities can be effectively exhibited. Examples of the silicone polymer antifoaming agent include organopolysiloxanes, among which, in particular, a fluorine-containing organopolysiloxane such as trifluoropropylmethyl silicone oil is suitable. The blend ratio of the antifoaming agent is set approximately in a range from 0.005 mass % to 0.1 mass % of the total amount of the composition in view of a balance between the resulting antifoaming effect and economic efficiency and the like.

The biodegradable lubricating oil composition according to the exemplary embodiment is excellent in lubricity, oxidation stability and biodegradability, and thus can be suitably used as lubricating oils such as gear oil and bearing oil. In particular, the composition is suitable as a lubricating oil used for a power transmission device with a planet gear (e.g., step-up gear) in a wind power generator, which is intended to be continuously used outside for a long time.

EXAMPLES

Next, examples of the invention will be described below in detail. However, it should be noted that the scope of the invention is by no means limited by the examples.

Examples 1-2, Comparatives 1-4

Various ester base oils were blended with various additives, and the resulting lubricating oil compositions (sample oils) were evaluated in various aspects.

Details of the esters used as base oils and additives are as follows. Table 1 shows the properties of carboxylates.

TABLE 1

| | Viscosity @ 40° C. ($mm^2/s$) | Acid Value (mgKOH/g) | Saponification Value (mgKOH/g) | Bio-degrad-ability (%) |
|---|---|---|---|---|
| Ester A (Component A) | 492.7 | 0.12 | 222 | 52 |
| Ester B (Component A) | 457.4 | 0.16 | 403 | 49 |
| Ester C | 312.3 | 0.60 | 220 | 60 |
| Ester D | 556.8 | 3.30 | 172 | 62 |
| Ester E (Component B) | 33.5 | 0.04 | 287 | 88 |
| Ester F | 105.0 | 0.06 | 176 | 65 |

(1) Ester A (Component A)

A complex ester formed from pentaerythritol, sebacic acid and isostearic acid (PRIOLUBE 1851 manufactured by Uniqema Ltd.) was used.

(2) Ester B (Component A)

A complex ester formed from pentaerythritol, adipic acid and mixed monocarboxylic acid having approximately 7 to 10 carbon atoms (PAF-450 manufactured by The Nisshin OilliO Group, Ltd.) was used.

(3) Ester C

A complex ester formed from pentaerythritol, sebacic acid and oleic acid (PRIOLUBE 2087 manufactured by Uniqema Ltd.) was used.

(4) Ester D

A di(pentaerythritol)oleate (TOE-500 manufactured by NOF Corporation) was used.

(5) Ester E (Component B)

An ester formed from pentaerythritol and saturated fatty acid (KAOLUBE 262 manufactured by Kao Corporation) was used.

(6) Ester F

A trimethylolpropane diisostearate was used.

(7) Phosphate Amine Salt (Component C)

Tridecyl acid phosphate and trioctylamine were used.

(8) Sulfur Compound (Component D)

Methylene bisdibutyldithiocarbamate and tris(2,4-C9-C10 isoalkylphenol)thiophosphate were used.

(9) Antioxidant

IRGANOX L107 (phenol-based) manufactured by Ciba Specialty Chemicals Inc. was used. IRGANOX L57 (amine-based) manufactured by Ciba Specialty Chemicals Inc. was used.

(10) Metal Deactivator

IRGAMET39 (a benzotriazole derivative) manufactured by Ciba Japan K.K. was used.

(11) Rust Inhibitor

A polybutenyl succinimide was used.

(12) Antifoaming Agent

A silicone antifoaming agent (KF96H12500CS manufactured by Shin-Etsu Chemical Co., Ltd.) was used.

(13) Anti-Emulsifier

LUBRIZOL 5957 (PAG-based) manufactured by Lubrizol Co., Ltd. was used.

Properties-measurement methods and evaluation methods for base oils and sample oils were as follows. Table 2 shows evaluation results of sample oils (biodegradability, oxidation stability, lubricity).

(1) Kinematic Viscosity

A kinematic viscosity was measured according to JIS K 2283.

(2) Acid Value

An acid value was measured according to JIS K 2501.

(3) Saponification Value

A saponification value was measured according to JIS K 2503.

(4) Sulfur Content

A sulfur content was measured according to JIS K 2541.

(5) Phosphorus Content

A phosphorus content was measured according to ASTM D 5185.

(6) Biodegradability

A biodegradation rate was measured according to the modified MITI test method (OECD301C). According to the authorized standard of ECOMARK (Environmental Labeling System) revised in July, 1998, a biodegradation rate is required to be 60% or more.

(7) Friction Coefficient (LFW-1 Test)

Using a block-on-ring tester (LFW-1) according to ASTM D2174, a coefficient of friction between metals was measured to evaluate the lubricity of each sample oil. Specific testing conditions were as follows.

Test Jigs

Ring: Falex S-10 Test Ring (SAE4620 Steel)

Bock: Falex H-60 Test Block (SAE01 Steel)

Operation Conditions

Oil Temperature: 60 degrees C.

Load: 89.0 N (20 lbs), 130.4 N (20 lbs), 177.9 N (40 lbs), 222.4 N (50 lbs)

Rotation Speed: 500 rpm (8) Gear Transmission Efficiency

A gear transmission efficiency was measured using the following measuring unit and measurement conditions. Table 2 shows measurement results regarding two load factors (53% and 88%).

Measuring Unit

A unit provided by the following devices 1) to 6) and the like coupled together in parallel in this numerical order was used.

1) Motor: A motor "SF-JR" manufactured by Mitsubishi Electric Corporation

2) Torque meter for measuring input torque: A torque meter "TOR-5" manufactured by NIKKEI ELECTRONIC INSTRUMENTS Co., Ltd.

3) Gear Unit: A gear unit "GL6-30" manufactured by AOKI SEIMITSU KOGYO Co., Ltd. (reduction ratio: 30:1)

4) Torque meter for measuring output torque: A torque meter "TOR-100" manufactured by NIKKEI ELECTRONIC INSTRUMENTS Co., Ltd.

5) Step-up gear: A step-up gear "ER-170" manufactured by SHIMPO CORPORATION

6) Hydraulic pump: A hydraulic pump "V-104C" manufactured by Tokimec Inc.

Incidentally, a coupling "CF-A-012-S12-1360" manufactured by Miki Pulley Co., Ltd. was used for coupling 1) to 2)

and 2 to 3) and a coupling "CF-A-050-S12-1360" manufactured by Miki Pulley Co., Ltd. was used for coupling 3) to 4).

A blower for cooling the gear unit was located at an approximately one meter distance from the gear unit.

Measurement Conditions

The motor was rotated at 1800 rpm to drive the gear unit (reduction ratio: 30:1) and also to drive the hydraulic pump via the step-up gear. When the oil temperature became 39±0.5 degrees C., an input torque (Ti) and an output torque (To) were measured with the torque meter to calculate a gear transmission efficiency by the following expression.

Incidentally, before measurements for the gear oils of Examples and Comparatives, running-in (motor rotation speed: 1800 rpm) was performed using BONNOC M460 manufactured by Nippon Oil Corporation.

(10) Timken Test

According to ASTM D 2782, the test was performed under the conditions including 800 rpm and 10 minutes, and a maximum load intended not to cause seizure was shown in lbs. When the value of the load is 45 or more, it is passable.

(11) FZG Seizure Test

According to ASTM D 5182-91, the test was performed under the conditions including 90 degrees C., 1450 rmp and 15 minutes, and the result was shown in a scuffing generating load stage.

(12) FZG Micropitting Test

Based on the above FZG seizure test, the result was shown in a micropitting generating load stage.

TABLE 2

| | | | | Example 1 | Example 2 | Comparative 1 | Comparative 2 | Comparative 3 | Comparative 4 |
|---|---|---|---|---|---|---|---|---|---|
| Composition Ratio mass % | Base Oil | Ester A (Component A) | | 80.15 | — | — | — | — | — |
| | | Ester B (Component A) | | — | 80.15 | — | — | — | — |
| | | Ester C | | — | — | 80.15 | — | — | — |
| | | Ester D | | — | — | — | 80.16 | — | — |
| | | Ester E (Component (B) | | 16.00 | 16.00 | 16.00 | 16.00 | — | — |
| | | Ester F | | — | — | — | — | 10.00 | 10.00 |
| | | PAO | | — | — | — | — | 86.16 | — |
| | | Mineral Oil | | — | — | — | — | — | 86.16 |
| | Additive | Phosphate Amine Salt (Component C) | Tridecyl Acid Phosphate | 0.27 | 0.27 | 0.27 | 0.27 | 0.27 | 0.27 |
| | | | Trioctylamine | 0.32 | 0.32 | 0.32 | 0.32 | 0.32 | 0.32 |
| | | Sulfur Compound | Dithiocarbamate | 1.65 | 1.65 | 1.65 | 1.65 | 1.65 | 1.65 |
| | | | Thiophosphate | 0.40 | 0.40 | 0.40 | 0.40 | 0.40 | 0.40 |
| | | Antioxidant | Phenol-based | 0.50 | 0.50 | 0.50 | 0.50 | 0.50 | 0.50 |
| | | | Amine-based | 0.50 | 0.50 | 0.50 | 0.50 | 0.50 | 0.50 |
| | | Metal Deactivator | Benzotriazole Derivative | 0.05 | 0.05 | 0.05 | 0.05 | 0.05 | 0.05 |
| | | Rust Inhibitor | Monoimide | 0.05 | 0.05 | 0.05 | 0.05 | 0.05 | 0.05 |
| | | Antifoaming Agent | Silicone-hased | 0.10 | 0.10 | 0.10 | 0.10 | 0.10 | 0.10 |
| | | Anti-emulsifier | PAG | 0.01 | 0.01 | 0.01 | 0.01 | 0.01 | 0.01 |
| | Element Content (mass ppm) | | P Content | 390 | 390 | 390 | 380 | 380 | 380 |
| | | | S Content | 5200 | 5300 | 510 | 520 | 510 | 510 |
| Evaluation Result | Biodegradability (degradation rate %) | | | 67 | 66 | 69 | 64 | 6 | 8 |
| | Friction Coefficient (LFW-1) | | 20 lbs | 0.029 | 0.032 | 0.033 | 0.029 | 0.057 | 0.620 |
| | | | 30 lbs | 0.036 | 0.036 | 0.039 | 0.033 | 0.063 | 0.660 |
| | | | 40 lbs | 0.044 | 0.045 | 0.047 | 0.041 | 0.069 | 0.710 |
| | | | 50 lbs | 0.054 | 0.053 | 0.056 | 0.052 | 0.076 | 0.820 |
| | Gear Transmission Efficiency | | Load Factor 53% | 92.7 | 92.6 | 92.1 | 92.8 | 90.8 | 89.6 |
| | | | Load Factor 88% | 94.6 | 94.7 | 94.1 | 94.9 | 92.8 | 91.8 |
| | Oxidation Stability Test | | Viscosity Increase Ratio @ 100° C. (%) | 3.8 | 3.2 | 16.4 | 18.9 | 1.6 | 2.2 |
| | | | Acid Value Increment (mg KOH/g) | 0.07 | 0.05 | 1.86 | 1.66 | 0.01 | 0.05 |
| | | | Filter Residue (mg/100 ml) | 0.2 | 0.1 | 32.0 | 48.0 | 0.0 | 0.2 |
| | Timken Test | | Maximum Load (lbs) | 65 | 65 | 70 | 65 | 65 | 65 |
| | FZG Seizure Test | | 14 Stage | pass | pass | pass | pass | pass | pass |
| | FZG Micropitting Test | | 10 Stage | pass | pass | pass | pass | pass | pass |

Calculation of Gear Transmission Efficiency

A gear transmission efficiency was calculated by the following equation.

$$\text{Gear transmission efficiency (\%)}=100\times To/Ti/30=3.3333To/Ti$$

(9) Oxidation Stability Test

According to ASTM D 2893, each sample oil was oxidized with air (121 degrees C., 312 hours) under predetermined conditions, and then an increase ratio of kinematic viscosity at 100 degrees C., an acid value increment, and a sludge amount after filtering through a millipore filter were measured.

Evaluation Results

As shown in Table 2, the sample oils of Examples 1 and 2, being provided by blending the components (A), (B) and (C), are excellent in all of lubricity, oxidation stability and biodegradability. Thus, it is understandable that these sample oils exhibit excellent properties as, for instance, an oil for a step-up gear used in a wind power generator. In contrast, the sample oils of Comparatives 1 and 2 are inferior in oxidation stability. It is because that each of the ester C and the ester D, which are used as the base oils of these sample oils, has a structure using an unsaturated fatty acid unlike the ester A. The sample oils of Comparatives 3 and 4 are inferior not only in biodegradability but also in lubricity. Each of these sample oils uses PAO or a mineral oil as the base oil thereof and is provided by blending the ester F (branched aliphatic carboxylic acid polyalcohol ester) at 10 mass %.

The invention claimed is:

1. A biodegradable lubricating oil composition, comprising:

(A) a first ester obtained by reacting (a1) a saturated aliphatic carboxylic acid, (a2) a straight-chain aliphatic dicarboxylic acid, and (a3) a polyhydric alcohol together, wherein the first ester (A) has a kinematic viscosity in a range from 400 $mm^2/s$ to 1000 $mm^2/s$ at 40 degrees C. and an acid value of 0.5 mgKOH/g or less;

(B) a second ester obtained by reacting (b 1) a straight-chain saturated aliphatic carboxylic acid with (b2) a polyhydric alcohol, wherein the second ester (B) has an acid value of 0.5 mgKOH/g or less and a kinematic viscosity in a range from 20 $mm^2/s$ to 40 $mm^2/s$ at 40 degrees C.; and (C) a phosphate amine salt obtained by reacting (c1) an acidic phosphate with (c2) an alkylamine, wherein the lubricating oil composition has a biodegradation rate of 60% or more, and wherein the composition is free of polyalphaolefins and mineral oils.

2. The composition of claim 1, wherein the saturated aliphatic carboxylic acid (a1) in the component (A) comprises 6 to 24 carbon atoms.

3. The composition of claim 1, wherein the straight-chain aliphatic dicarboxylic acid (a2) in the component (A) comprises 12 carbon atoms or less.

4. The composition of claim 1, wherein the straight-chain saturated aliphatic carboxylic acid (b 1) in the component (B) comprises 6 to 12 carbon atoms.

5. The composition of claim 1, wherein at least one selected from the group consisting of the polyhydric alcohol (a3) and the polyhydric alcohol (b2) comprises at least one selected from the group consisting of pentaerythritol and trimethylolpropane.

6. The composition of claim 1, wherein a blend ratio of the component (B) is 10 mass% or more of a total amount of the lubricating oil composition.

7. The composition of claim 1, wherein a blend ratio of the phosphate amine salt in the component (C) is in a range from 0.2 mass% to 1 mass%.

8. The composition of claim 1, in the form of a gear oil.

9. The composition of claim 2, wherein the straight-chain aliphatic dicarboxylic acid (a2) in the component (A) comprises 12 carbon atoms or less.

10. The composition of claim 2, wherein the straight-chain saturated aliphatic carboxylic acid (b1) in the component (B) comprises 6 to 12 carbon atoms.

11. The composition of claim 2, wherein at least one selected from the group consisting of the polyhydric alcohol (a3) and the polyhydric alcohol (b2) comprises at least one selected from the group consisting of pentaerythritol and trimethylolpropane.

12. The composition of claim 1, wherein the polyhydric alcohol (a3) comprises pentaerythritol.

13. The composition of claim 1, wherein the polyhydric alcohol (a3) comprises trimethylolpropane.

14. The composition of claim 1, wherein the polyhydric alcohol (b2) comprises pentaerythritol.

15. The composition of claim 1, wherein the polyhydric alcohol (b2) comprises trimethylolpropane.

16. The biodegradable lubricating oil composition according to claim 1, wherein a content of phosphorus (P) is in a range from 150 mass ppm to 500 mass ppm based on the total amount of the lubricating oil composition.

17. The composition of claim 1, wherein the acidic phosphate (c1) in the component (C) is represented by a formula (1),

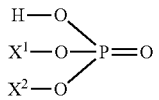

(1)

wherein $X^1$ is a hydrogen atom or an alkyl group having 6 to 20 carbon atoms and $X^2$ is an alkyl group having 6 to 20 carbon atoms.

18. The composition of claim 1, wherein the acidic phosphate (c1) in the component (C) is selected from the group consisting of monooctyl acid phosphate, monodecyl acid phosphate, monoisodecyl acid phosphate, monolauryl acid phosphate, mono(tridecyl) acid phosphate, monomyristyl acid phosphate, monopalmityl acid phosphate, monostearyl acid phosphate, dioctyl acid phosphate, didecyl acid phosphate, diisodecyl acid phosphate, dilauryl acid phosphate, di(tridecyl) acid phosphate, dipalmityl acid phosphate and distearyl acid phosphate.

19. The composition of claim 1, wherein the lubricating oil composition has a biodegradation rate of 60% to 69%.

* * * * *